US006224293B1

(12) United States Patent
Smith

(10) Patent No.: US 6,224,293 B1
(45) Date of Patent: May 1, 2001

(54) VARIABLE AMPLITUDE VIBRATION GENERATOR FOR COMPACTION MACHINE

(75) Inventor: William M. Smith, Kewanee, IL (US)

(73) Assignee: Compaction America, Inc., Kewanee, IL (US)

( * ) Notice: Subject to any disclaimer, the term of this patent is extended or adjusted under 35 U.S.C. 154(b) by 0 days.

(21) Appl. No.: 09/294,292

(22) Filed: Apr. 19, 1999

(51) Int. Cl.[7] ..... E01C 19/38

(52) U.S. Cl. ..... 404/117; 404/122; 404/133.05; 74/61; 74/87

(58) Field of Search ..... 404/117, 122, 404/133.05; 74/61, 87; 464/3, 180, 185

(56) References Cited

U.S. PATENT DOCUMENTS

| | | | | |
|---|---|---|---|---|
| 2,861,458 | * | 11/1958 | Awedissjan | 74/87 |
| 3,040,591 | * | 6/1962 | Peregrine et al. | 74/61 |
| 3,505,886 | * | 4/1970 | Hill et al. | 74/61 |
| 3,515,043 | | 6/1970 | Austin . | |
| 3,606,796 | * | 9/1971 | Pappers | 404/117 |
| 3,616,703 | | 11/1971 | Waschulewski et al. . | |
| 3,822,604 | * | 7/1974 | Grimmer | 74/87 |
| 3,896,677 | | 7/1975 | Larson . | |
| 4,033,193 | | 7/1977 | Brander . | |
| 4,105,356 | | 8/1978 | Loveless . | |
| 4,108,009 | | 8/1978 | Fuchigami . | |
| 4,176,983 | | 12/1979 | Gardner . | |
| 4,262,549 | | 4/1981 | Schwellenbach . | |
| 4,342,523 | | 8/1982 | Salani . | |
| 4,459,866 | | 7/1984 | Feldkamper . | |
| 4,499,799 | | 2/1985 | Maass . | |
| 4,577,995 | | 3/1986 | Sadahiro . | |
| 4,580,456 | * | 4/1986 | Takano | 74/87 |
| 4,830,534 | | 5/1989 | Schmeltzer et al. . | |
| 4,927,289 | * | 5/1990 | Artzberger | 404/117 |
| 4,940,336 | | 7/1990 | Dryga et al. . | |
| 4,964,753 | | 10/1990 | Ciminelli et al. . | |
| 5,220,845 | * | 6/1993 | Anderson | 74/87 |
| 5,231,886 | * | 8/1993 | Quirk et al. | 74/61 |
| 5,388,470 | | 2/1995 | Marsh, Jr. . | |
| 5,618,133 | | 4/1997 | Mitsui et al. . | |
| 5,666,852 | | 9/1997 | Musschoot . | |
| 5,743,790 | | 4/1998 | Trahan . | |
| 5,818,135 | | 10/1998 | Riedel et al. . | |
| 5,829,304 | | 11/1998 | Woltering . | |
| 5,836,204 | | 11/1998 | Skak . | |

* cited by examiner

*Primary Examiner*—Eileen D. Lillis
*Assistant Examiner*—Alexandra K. Pechhold
(74) *Attorney, Agent, or Firm*—Kennedy Covington Lobdell & Hickman, L.L.P.

(57) ABSTRACT

A vibration generator includes a weight member, a shaft rotatable about an axis of rotation extending longitudinally therethrough and having a mounting area on which the weight member is mounted, and a positioning arm disposed in engagement with the weight member on the shaft and rotatable about the axis of rotation relative to both the shaft and the weight member. The mounting area engages the weight member and prevents movement of the weight member relative to the shaft in a circumferential direction about the axis of rotation but permits movement of the weight member relative to the shaft in a radial direction orthogonal to the axis of rotation and coplanar with the circumferential direction. The weight member also defines an elongate positioning slot and the positioning arm includes an axially extending portion disposed through the positioning slot for slidable movement within the positioning slot during rotation of the positioning member relative to the shaft. The axially extending portion in fact defines a cam surface disposed in engagement with the weight member within the positioning slot. Rotation of the positioning arm relative to both the shaft and the weight member moves the weight member relative to the shaft in a radial direction orthogonal to the axis of rotation thereby altering the moment of inertia of the weight member about the axis of rotation and resulting in a different amplitude of vibration during rotation of the weight member.

14 Claims, 11 Drawing Sheets

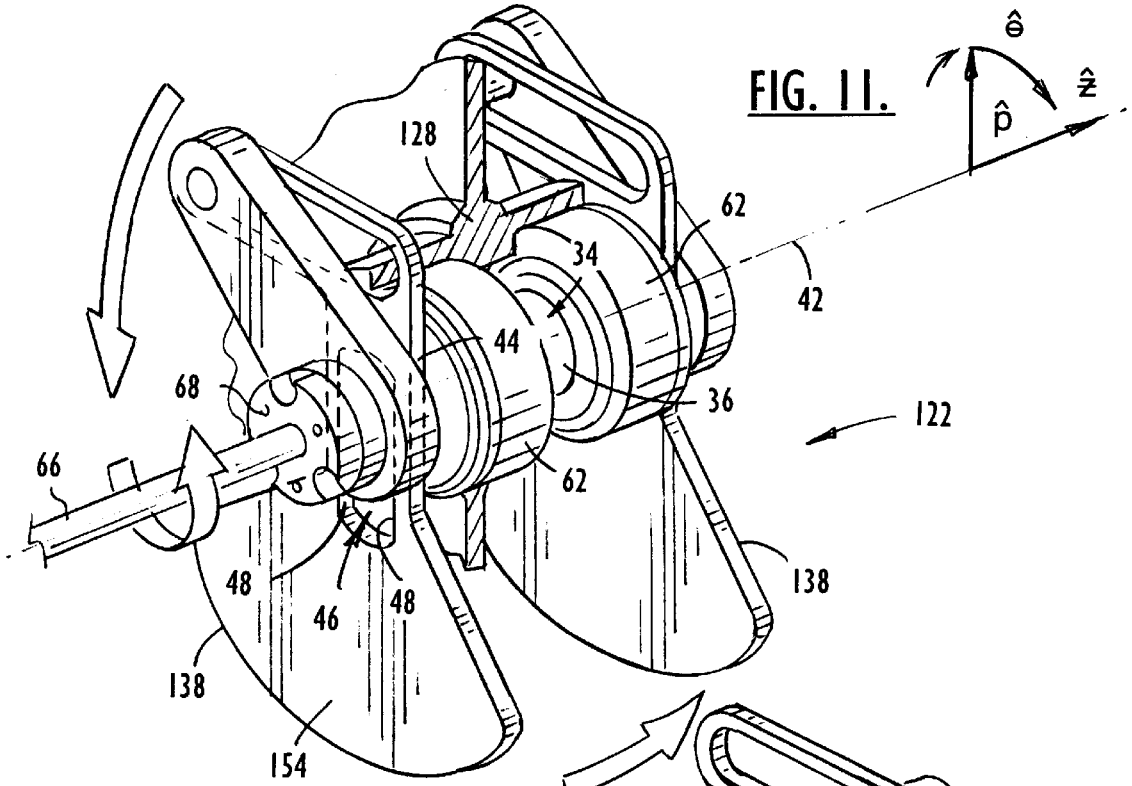
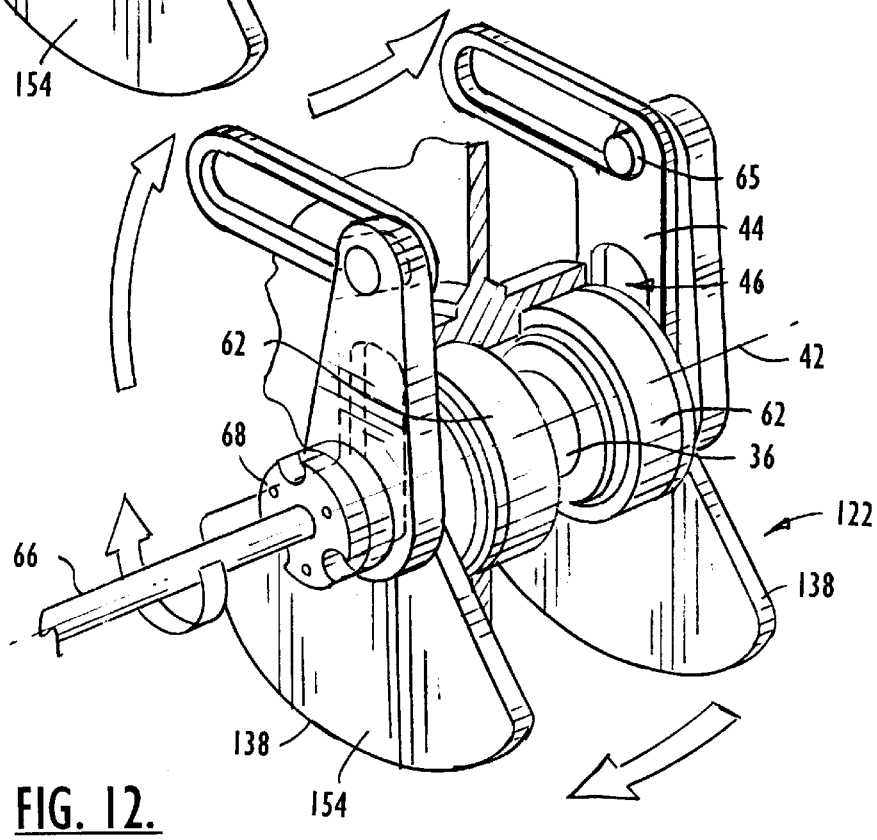
FIG. 12.

VARIABLE AMPLITUDE VIBRATION GENERATOR FOR COMPACTION MACHINE

FIELD OF THE PRESENT INVENTION

The present invention relates to a vibration generator for a compaction machine and, in particular, to a variable amplitude vibration generator for a compaction machine used in the road construction industry.

BACKGROUND OF THE PRESENT INVENTION

It is well known to use a compaction machine having a compaction drum in leveling a road surface in the road construction industry. Furthermore, it is also well known that better results and better efficiency are achieved by causing small high-frequency vibrations in the compaction drum during such leveling. Vibrations are often generated by rotating an eccentric weight within the compaction drum. Moreover, the amplitude of vibration is dependent upon the rotational rate of the eccentric weight; however, the amplitude of vibration is also dependent upon the radial spacing of the center of mass of the weight to the axis of rotation, i.e., the eccentricity of the weight.

In Schmelzer et al. U.S. Pat. No. 4,830,534 (the '534 Patent), vibrations in the compaction drum are generated by rotation of an eccentric weight mounted on a rotor shaft. A high amplitude of vibration or, alternatively, a low amplitude of vibration is produced depending upon the radial position of the eccentric weight with regard to the axis of rotation of the shaft. Springs are provided in the mounting of the eccentric weight and, when the eccentric weight is not undergoing rotation, the springs urge the eccentric weight into a default radial position in abutment with the shaft. A latch fixedly mounted to the shaft controls the radial positioning of the eccentric weight as well as drives the rotation of the eccentric weight. In particular, the latch includes a slot and the eccentric weight, which is rotatably mounted on the shaft, includes a pin that extends axially through the slot. Rotation of the latch in a first direction causes the pin to move to a first end of the slot which, in turn, moves the weight into a low radial position with respect to the axis of rotation, thereby generating a low amplitude of vibration. Furthermore, the slot is C-shaped or L-shaped and a side of the slot engages the pin and thereby restrains the weight from moving into a higher radial position. Rotation of the latch in the reverse direction causes the pin to move to the other end of the slot and causes the eccentric weight to move into a high radial position, thereby generating a high amplitude of vibration.

An object of the present invention is to provide a vibration generator for a compaction machine which exhibits both high and low amplitude of vibration states without utilizing the vibration generator of the '534 Patent.

SUMMARY OF THE PRESENT INVENTION

The vibration generator for a compaction machine of the present invention includes a weight member, a shaft rotatable about an axis of rotation extending longitudinally through the weight member and having a mounting area on which the weight member is mounted, and a positioning arm disposed in engagement with the weight member and rotatable about the axis of rotation relative to both the shaft and the weight member. Rotation of the positioning arm relative to both the shaft and the weight member moves the weight member relative to the shaft in a radial direction orthogonal to the axis of rotation thereby altering the moment of inertia of the weight member about the axis of rotation and resulting in a different amplitude of vibration during rotation of the weight member.

In a feature of the present invention, the mounting area engages the weight member and prevents movement of the weight member relative to the shaft in a circumferential direction about the axis of rotation but permits movement of the weight member relative to the shaft in a radial direction orthogonal to the axis of rotation and coplanar with the circumferential direction. In a preferred embodiment of the present invention, the weight member includes an elongate mounting slot having a pair of opposed parallel planar sides between which the mounting area of the shaft extends, and the mounting area includes parallel planar surfaces disposed in sliding abutment with the planar sides.

In a further feature of the present invention, the weight member defines an elongate positioning slot and the positioning arm includes an axially extending portion disposed through the positioning slot for slidable movement within the positioning slot during rotation of the positioning member relative to the shaft. Furthermore, the axially extending portion in fact defines a cam surface disposed in engagement with the weight member within the positioning slot. In a preferred embodiment of the present invention, the weight member includes a weighted portion and an arm portion extending from the weighted portion, with the weighted portion defining the positioning slot and the arm portion defining the elongate mounting slot. In an alternative preferred embodiment including this feature, the weight member includes a weighted portion, an offsetting portion disposed opposite the weighted portion relative to the axis of rotation, and an arm portion extending between and connecting the weighted portion and the offsetting portion, with the offsetting portion defining the positioning slot and the arm portion defining the elongate mounting slot.

In a further feature of the present invention, the positioning slot extends along its length from an end thereof away from the axis of rotation and then extends in closer proximity to the axis of rotation. In one preferred embodiment including this feature, the positioning slot is generally checkmark shaped. In an alternative preferred embodiment, the positioning slot extends parallel to a plane orthogonal to the axis of rotation and perpendicularly intersects a radial line orthogonal to the axis of rotation.

Preferably, in each embodiment of the present invention the center of mass of the weight member is located in a pie-wedged weighted portion thereof.

The present invention also includes a compaction machine including the vibration generator of the present invention.

BRIEF DESCRIPTION OF THE DRAWINGS

Further features, embodiments, and advantages of the present invention will become apparent form the following detailed description with reference to the drawings, wherein:

FIG. 11 is a perspective view of another embodiment of the variable amplitude vibration generator of the present invention in a high-amplitude position;

FIG. 12 is a perspective view of the variable amplitude vibration generator of FIG. 11 in a low-amplitude position;

DETAILED DESCRIPTION OF PREFERRED EMBODIMENTS

Figure 1:
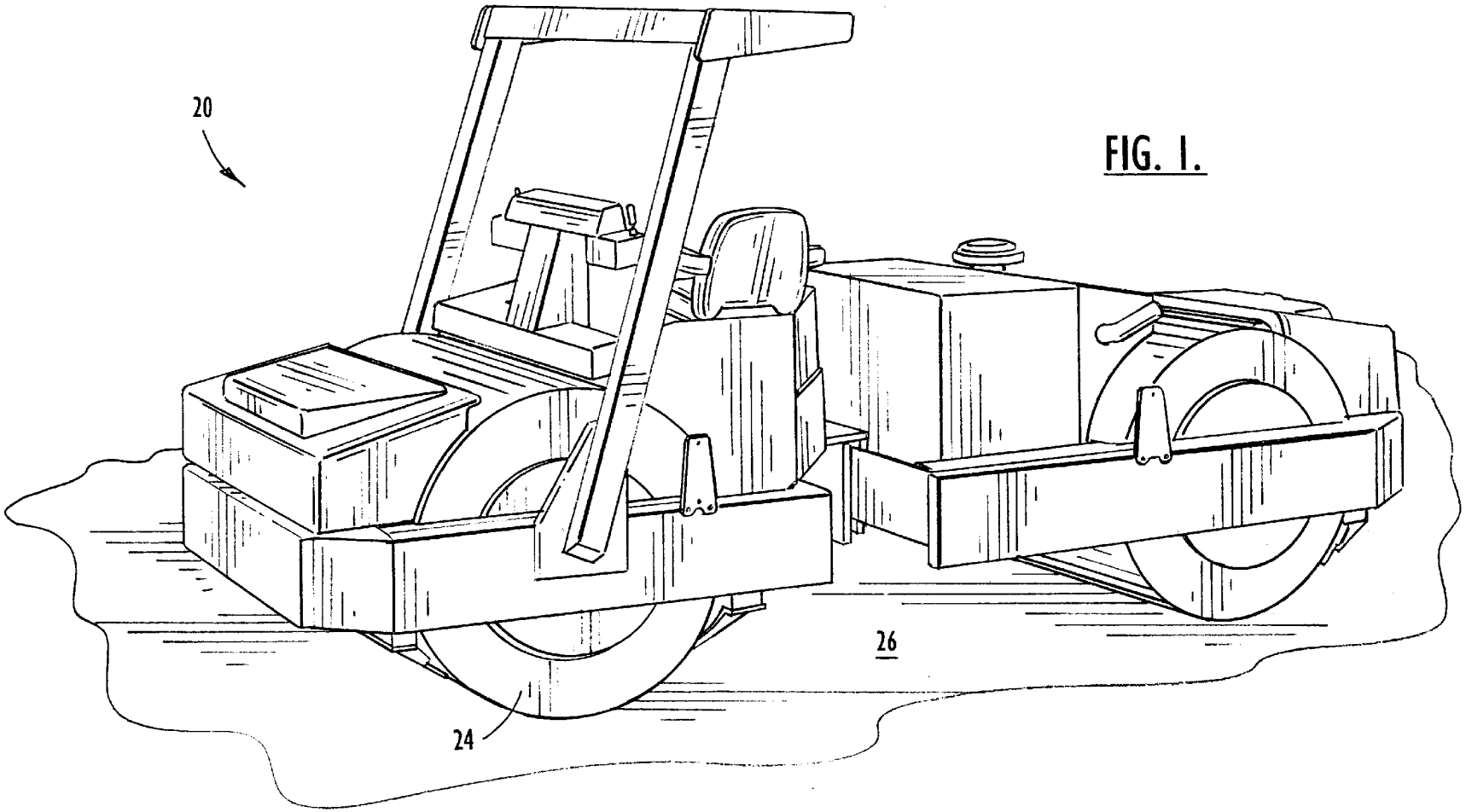
FIG. 1 is a perspective view of a compaction machine used in the road construction industry in which the variable amplitude vibration generator of the present invention is preferably utilized.

A compaction machine 20 used in the road construction industry is generally shown in FIG. 1, and the variable amplitude vibration generator of the present invention (hereinafter simply referred to as "vibration generator" for brevity) is preferably used in this type of compactor for transmitting variable amplitude vibrations to a compaction drum 24 during leveling of a recently paved road surface 26. Two preferred embodiments of the present invention are shown in the drawings. A first embodiment is shown in FIGS. 2–9 and a second embodiment is shown in FIGS. 11–16. Each of these two preferred embodiments includes a shaft, two weight members, and two positioning arms. However, the basic construction of the preferred vibration generator of the present invention includes only a shaft having a single weight member and a single positioning arm mounted thereon and, as will be apparent to one having ordinary skill in the art, any number of pairs of a weight member and a positioning arm can be provided on the shaft as desired, with two pairs being preferred. Consequently, each pair of a weight member and a positioning arm in the illustrated preferred embodiments, and identical parts thereof, will be identified by identical reference numerals in the Figures.

Figure 2:
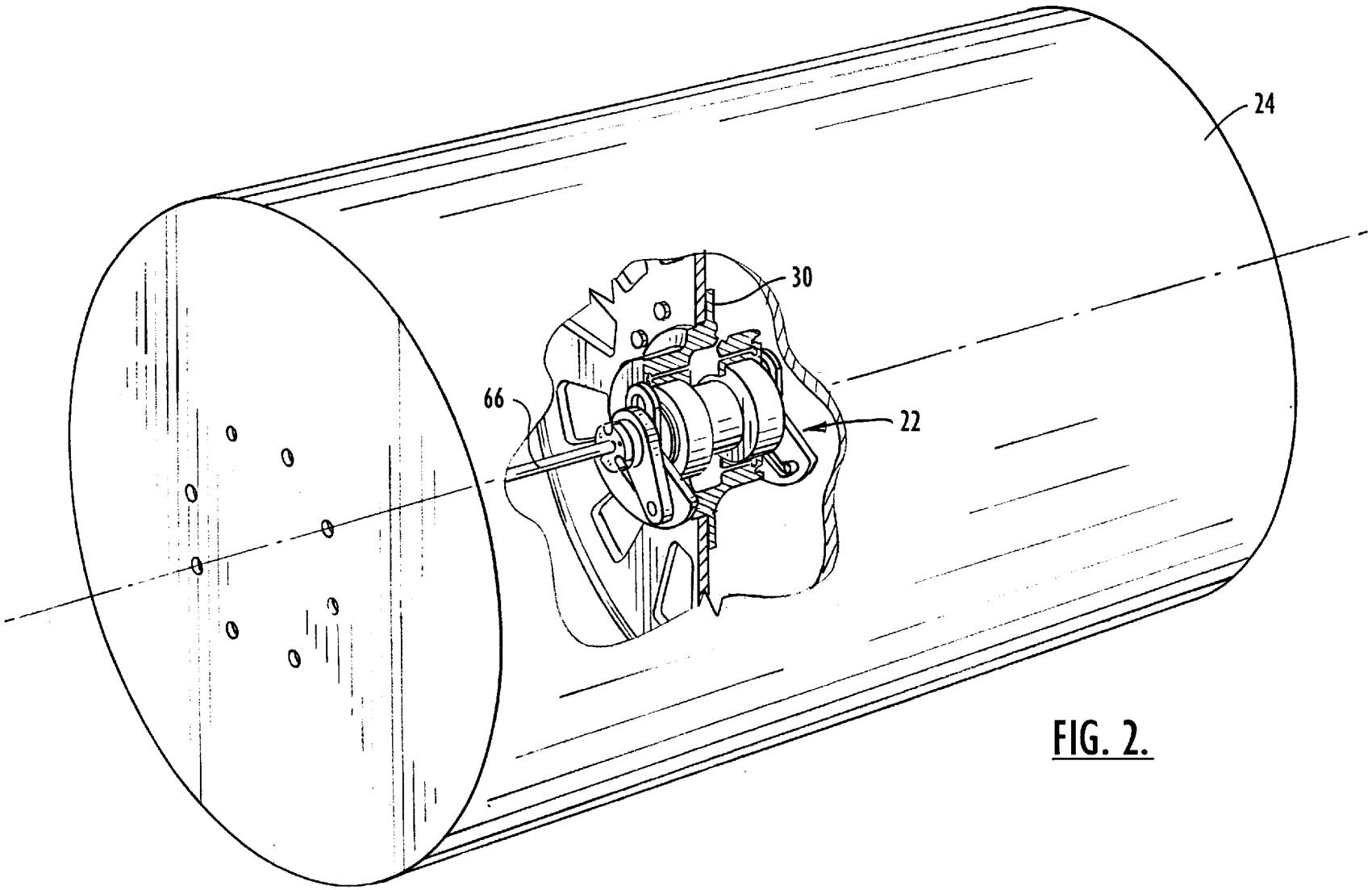
FIG. 2 is a partially broken-away perspective view a compaction roller of the compaction machine of FIG. 1 showing an embodiment of the variable amplitude vibration generator of the present invention.
Figure 3:
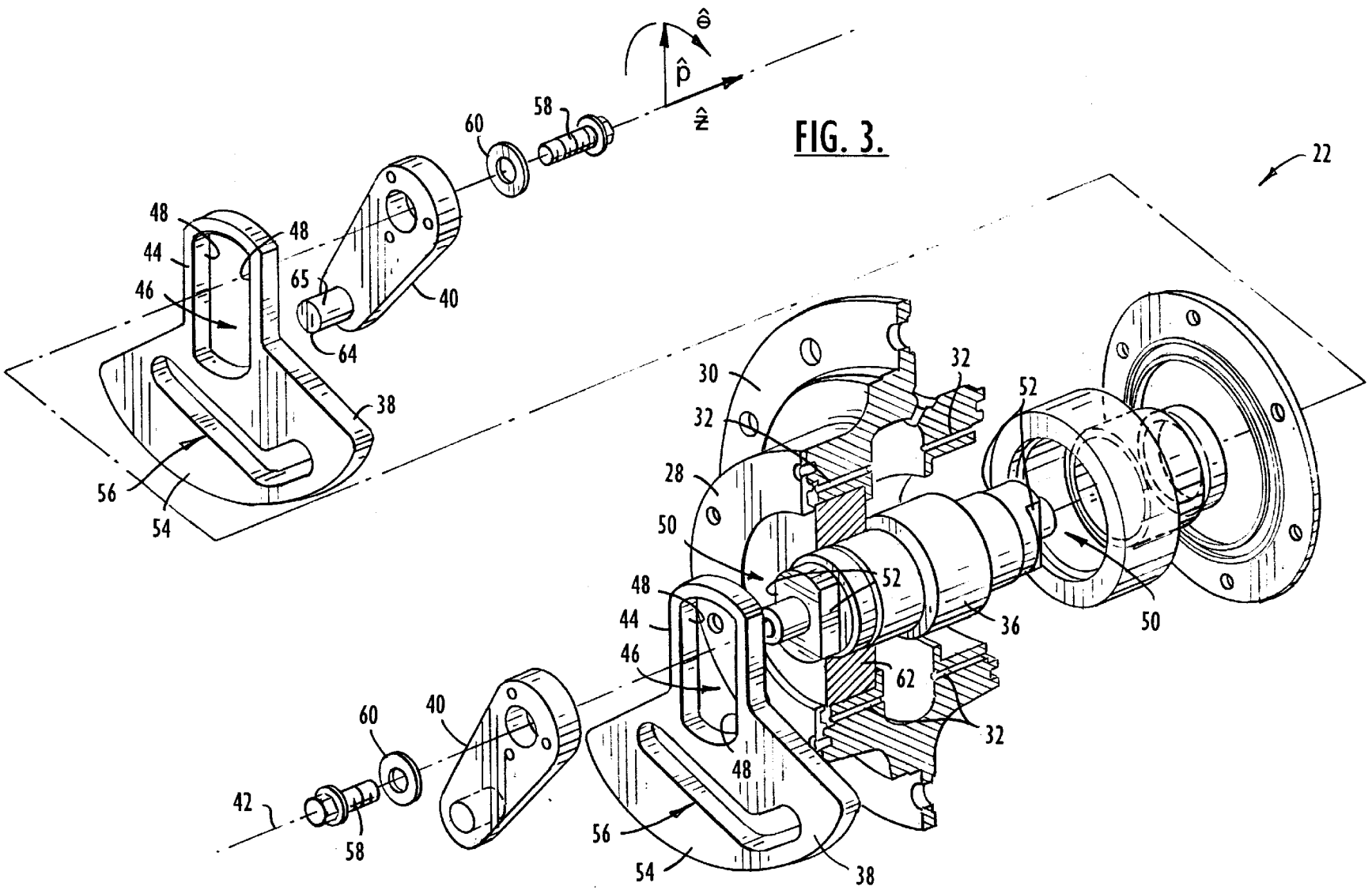
FIG. 3 is an exploded view in partial cross-section of the variable amplitude vibration generator and a bearing housing as shown in FIG. 2.

As shown in FIG. 2, a vibration generator 22 is disposed within the compaction drum 24 itself and is contained therein within a bearing housing 28 as shown in FIG. 3. The vibration generator 22 is not fixed directly to the compaction drum 24 and therefore does not necessarily rotate in direct correlation with the compaction drum 24. Instead, the bearing housing 28 is secured by a flange 30 to the compaction drum 24 and the vibration generator 22 is supported within the bearing housing 28 in slidable engagement therewith. Lubrication for this slidable engagement is provided by circulation of oil through passages 32 in the bearing housing 28 as shown in FIG. 3 or, alternatively, by packing grease within an enclosed area 34 of the bearing housing 128 surrounding the vibration generator 122 as shown in FIG. 11. Vibrations that are generated by the vibration generator 22,122 as discussed in greater detail below are transmitted to the compaction drum 24 and road surface 26 through contact between the vibration generator 22,122 and the bearing housing 28,128 of the compaction drum 24.

With specific regard first to the preferred embodiment illustrated in FIGS. 2–9, the vibration generator 22 includes a shaft 36 that is rotatable within the bearing housing 28 along an axis of rotation 42 with reference to which a radial direction $\rho$, an axial direction Z, and a circumferential direction $\theta$ are defined. The axis of rotation 42 extends longitudinally along the center of the shaft 36, and the radial direction $\rho$, axial direction Z, and circumferential direction $\theta$ are orthogonal to one another and define a cylindrical coordinate system.

The vibration generator 22 also includes a weight member 38. The weight member 38 includes an arm portion 44 which defines a mounting slot 46 having a pair of opposed parallel planar sides 48 between which a mounting area 50 of the shaft 36 extends. The mounting area 50 of the shaft 36 includes two parallel planar surfaces 52 which are disposed in sliding abutment with the planar sides 48 when the weight member 38 is mounted to the shaft 36, whereby the weight member 38 is movable relative to the shaft 36 in the radial direction $\rho$ but is precluded from movement relative to the shaft 36 in the circumferential direction $\theta$. The weight member 38 also includes a pie-shaped weighted portion 54 which defines a positioning slot 56 having a general check-mark configuration. Furthermore, a center of mass CM of the entire weight member 38 is located within the weighted portion 54.

The vibration generator 22 also includes a positioning arm 40 mounted on the shaft 36 adjacent the weight member 38 and rotatable about the axis of rotation 42 relative to both the shaft 36 and the weight member 38. A bolt 58 and washer 60 are secured to the end of the shaft 36 and retain the positioning arm 40 on the shaft 36. A bearing ring 62 is also mounted on the shaft 36 adjacent the other side of the weight member 38 whereby the weight member 38 is retained adjacent the positioning arm 40 and prevented from axial movement. The bearing ring 62 also represents the portion of the vibration generator 22 that slidably engages the bearing housing 28 and, thus, is the element that directly supports the vibration generator 22 within the bearing housing 28.

The positioning arm 40 includes an axially extending portion that extends through the positioning slot 56 defined by the weight member 38. The axially extending portion preferably comprises a cylindrical pin 64 which is slidable along the length of the positioning slot 56 during rotation of the positioning arm 40. The surface of the pin 64 engages the weight member 38 within the positioning slot 56 and acts as a cam surface 65 during rotation of the positioning arm 40 relative to the shaft 36 and weight member 38. The radial distance R from the axis of rotation 42 to the cylindrical pin 64 is constant.

Figure 4:
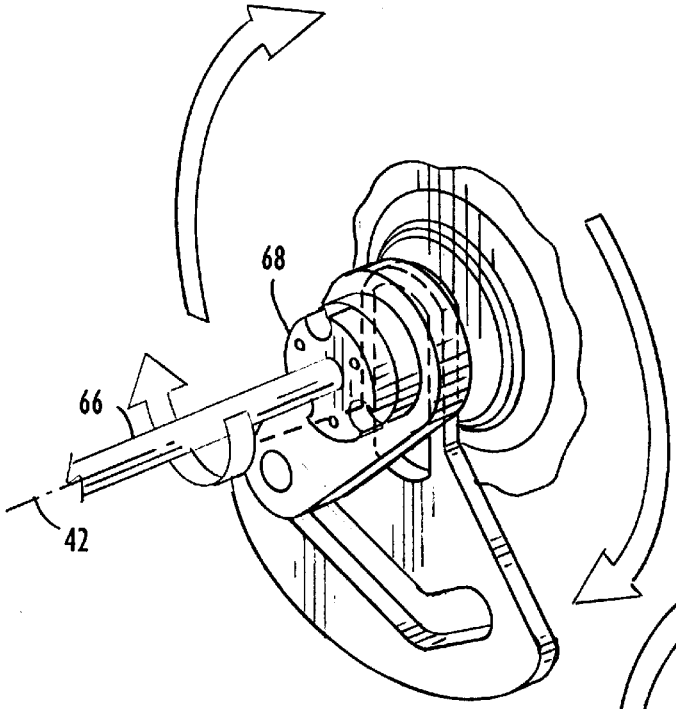
FIG. 4 is a perspective view of part of the variable amplitude vibration generator of FIG. 2 in a high-amplitude position.
Figure 5:
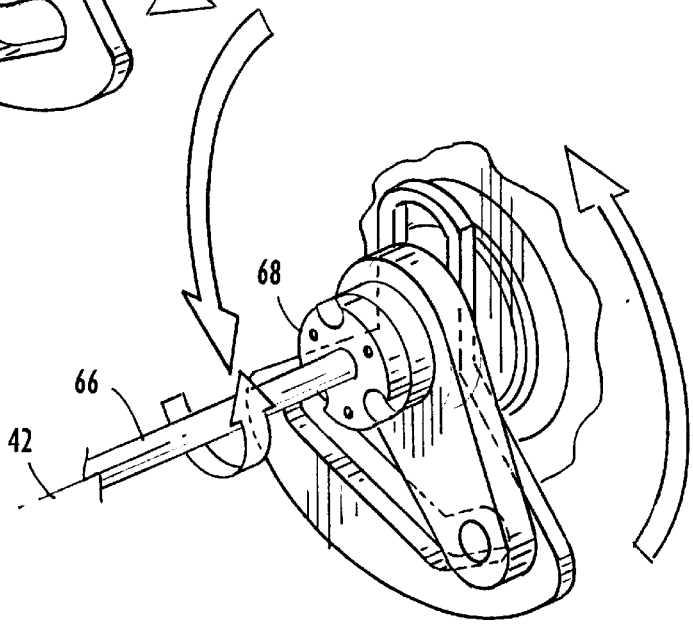
FIG. 5 is a perspective view of part of the variable amplitude vibration generator of FIG. 2 in a low-amplitude position.

As shown in FIGS. 2 and 4–5, but omitted in FIG. 3 for clarity, an actuating rod 66 is disposed coaxial with the shaft 36 of the vibration generator 22 and is mounted to the positioning arm 40 through a coupling member 68. The actuating rod 66 is driven in rotation by a motor arrangement (not shown) of the compaction machine 20, with driven rotation of the actuating rod 66 causing rotation of the positioning arm 40 about the axis of rotation 42. Preferably, the actuating rod 66 is linked to the compaction drum 24, whereby rotation of the compaction drum 24 drives rotation of the actuating rod 66. The direction of rotation of the actuating shaft 36 can be in either a clockwise or counterclockwise direction as desired. In such an arrangement, movement of the compaction drum 24 results initially in rotation of the actuating rod 66 and positioning arm 40. During rotation of the positioning arm 40, there is a sufficient lack of frictional force between the cylindrical pin 64 and weight member 38 to permit the cylindrical pin 64 extending through the positioning slot 56 to slide within the positioning slot 56 to an end thereof without causing any initial rotation of the weight member 38. Then, once the cylindrical pin 64 engages an end of the positioning slot 56, continued rotation of the positioning arm 40 by the actuating rod 66 results in corresponding rotation of the weight member 38 and shaft 36; hence, clockwise rotation of the actuating rod 66 results in clockwise rotation of the weight member 38 as shown in FIG. 4, and counterclockwise rotation of the actuating rod 66 results in counterclockwise rotation of the weight member 38 as shown in FIG. 5.

Different radial dispositions of the center of mass CM of the weight member 38 relative to the axis of rotation 42 results in different moments of inertia of the weight member 38 about the axis of rotation 42. Rotation of the weight member 38 in each different disposition therefore results in different amplitudes of vibration in the shaft 36 which, in turn, are transmitted through the bearing rings 62 to the bearing housing 28 and to the compaction drum 24.

In the vibration generator 22 of the present invention, the weight member 38 is selectively disposed relative to the axis of rotation 42 to generate different amplitudes of vibration during rotation thereof. Selective disposition of the weight member 38 preferably results from the configuration of the positioning slot 56 and direction of rotation of the positioning arm 40. In particular, the selective disposition of the pin 64 of the positioning arm 40 in each of the two opposed ends of the positioning slot 56 results in different radial dispositions of the weight member 38 and, thus, different amplitudes of vibration. Indeed, the disposition of the weight member 38 in FIG. 4 is shown in cross-sectional elevational view in FIG. 6, wherein the center of mass CM of the weight member 38 is disposed at a radial distance of $D_1$ to the axis of rotation 42. On the other hand, the disposition of the weight member 38 in FIG. 5 is shown in cross-sectional elevational view in FIG. 9, wherein the center of mass CM is disposed at a different radial distance $D_4$ to the axis of rotation 42, with $D_4$ being less than $D_1$. Consequently, the disposition of the weight member 38 shown in FIGS. 4 and 6 is a high-amplitude position (greater eccentricity of the weight member 38) which results in a higher amplitude of vibration than the amplitude of vibration generated by the disposition of the weight member 38 shown in FIGS. 5 and 9, which is a low-amplitude position (lower eccentricity of the weight member 38).

Furthermore, both the high-amplitude position and the low-amplitude position are stable in the vibration generator 22 of the present invention. This stability also results from the configuration of the positioning slot 56. As a result of so-called "centrifugal" force, the weight member 38 will naturally tend toward the greatest radial disposition of its center of mass CM during rotation. When the weight member 38 is rotated in the clockwise direction as shown in FIG. 4, the weight member 38 is in the high-amplitude position with the greatest radial distance to the axis of rotation 42 and, therefore, will remain in this disposition during rotation. In order to retain the weight member 38 in a stable low-amplitude position at a radial spacing less than that of the high-amplitude position, however, it is necessary to configured the positioning slot 56 so that a local minimum radial spacing of the center of mass CM of the weight member 38 is obtained during the transition of the weight member 38 from the high-amplitude position to the stable low-amplitude position. This is accomplished by configuring the positioning slot 56 to extend along its length from an end thereof away from the axis of rotation 42 and then in closer proximity to the axis of rotation 42. Consequently, rotation of the positioning arm 40 relative to both the shaft 36 and the weight member 38, which are locked together in the circumferential direction $\theta$, results in a center of mass CM of the weight member 38 moving relative to the shaft 36 first in a radial direction $-\rho$ toward the axis of rotation 42 and then in a radial direction $+\rho$ away from the axis of rotation 42. The movement of the cylindrical pin 64 between opposite ends of the slot results in the center of mass CM of the weight member 38 passing through a local minimum radial distance to the axis of rotation 42.

Figure 6:
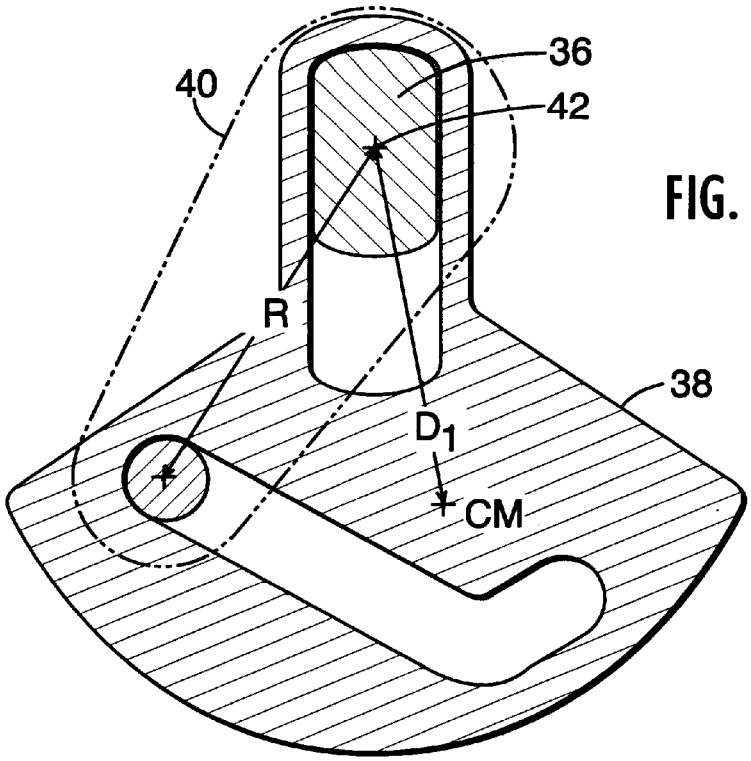
FIG. 6 is a cross-sectional elevational view of the variable amplitude generator of FIG. 2 in a high-amplitude position.
Figure 7:
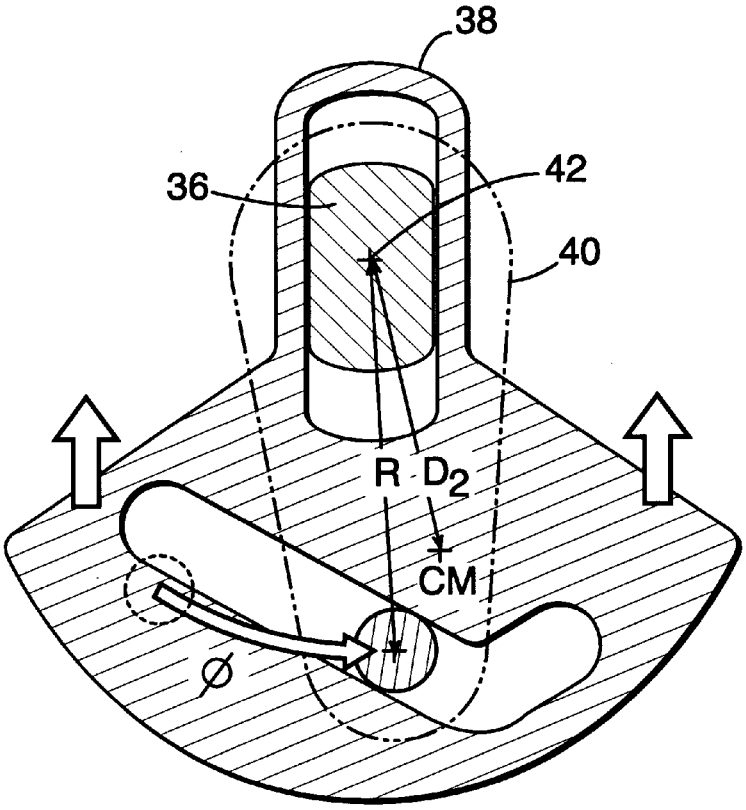
FIG. 7 is a cross-sectional elevational view of the variable amplitude generator of FIG. 2 in a first intermediate position during the transition thereof from a high-amplitude position to a stable low-amplitude position.
Figure 8:
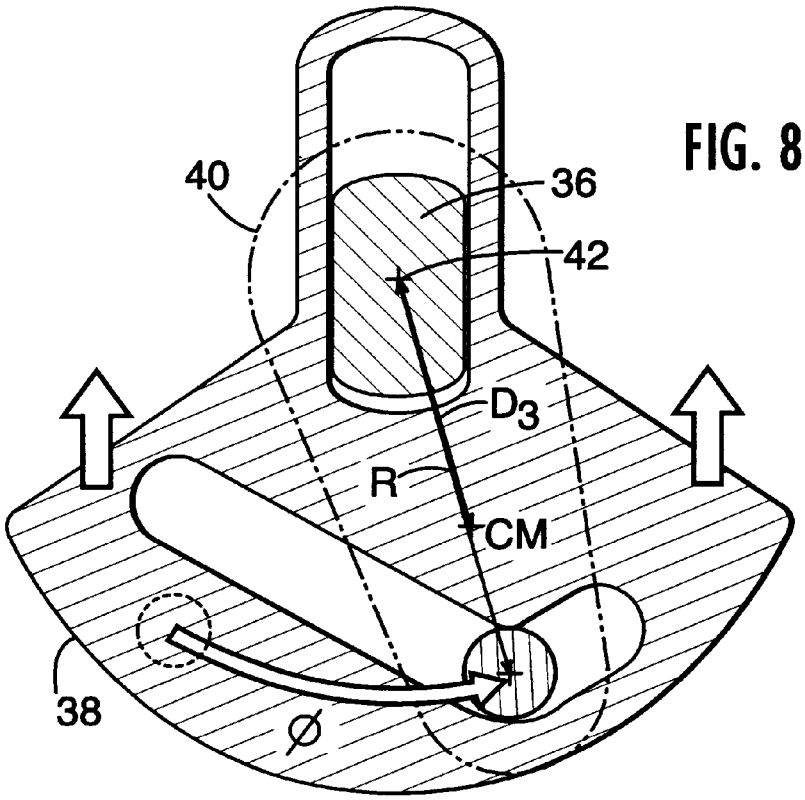
FIG. 8 is a cross-sectional elevational view of the variable amplitude generator of FIG. 2 in a second intermediate position during the transition thereof to a stable low-amplitude position.
Figure 9:
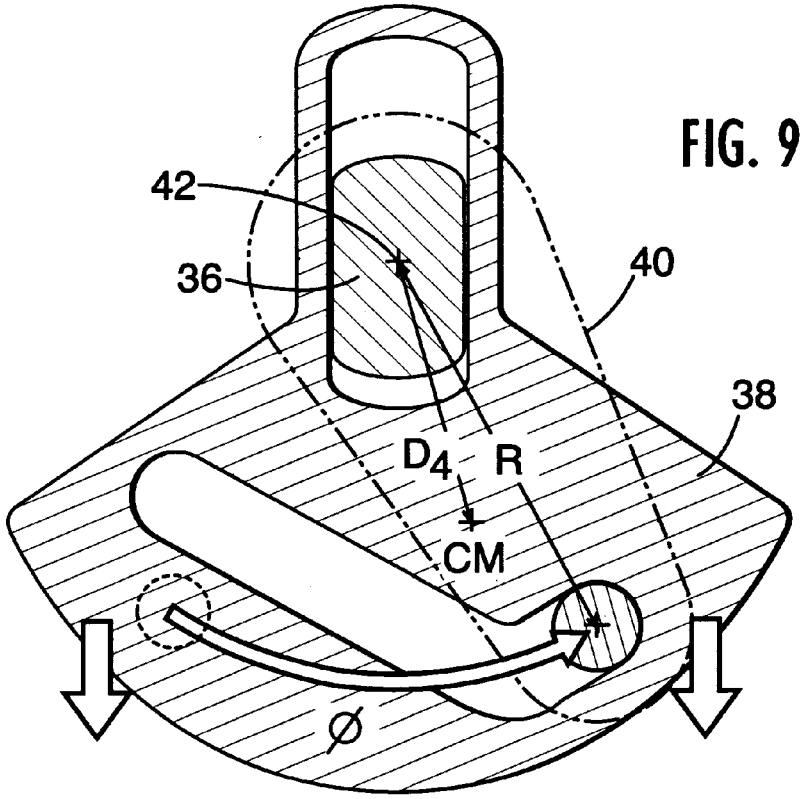
FIG. 9 is a cross-sectional elevational view of the variable amplitude generator of FIG. 2 in a low-amplitude position.

With reference to the sequence of the transition of the weight member 38 from the high-amplitude position as shown in FIG. 6 to the stable low-amplitude position as shown in FIG. 9, the radial distance of the center of mass CM first decreases from $D_1$ to $D_2$ (FIG. 7) and then to a minimum value of $D_3$ (FIG. 8), and then increases to $D_4$ (FIG. 9). While $D_4$ is less than $D_1$, $D_4$ is greater than $D_3$ and, therefore, the weight member 38 when in the stable low-amplitude position of FIG. 9 will nevertheless still be at a greater radial distance than $D_3$, will remain in such position, and will not tend toward the high-amplitude position of FIG. 6 as it would first have to pass through the even lower but unstable amplitude position of FIG. 8.

Figure 10:
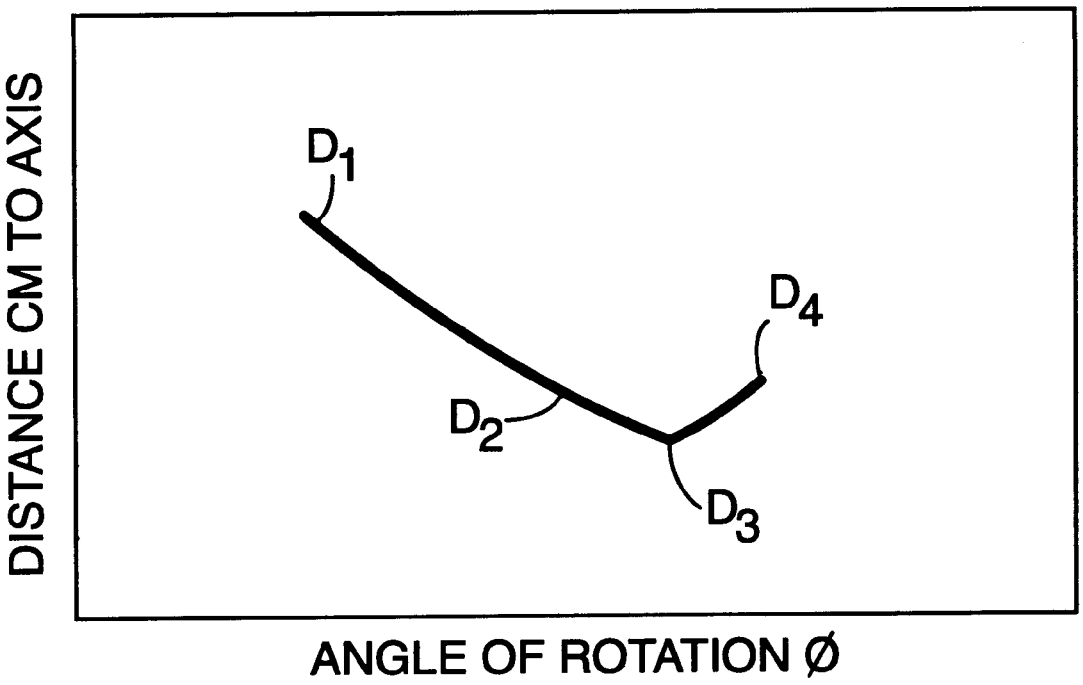
FIG. 10 is a very general graphical illustration of the radial spacing of rotation of the center of mass of the weight member as a function of rotation of the positioning arm of the variable amplitude vibration generator of FIG. 2.

The radial distance of the center of mass CM to the axis of rotation 42 is very generally illustrated in FIG. 10 for the sole purpose of comparing the relative values $D_1$,$D_2$,$D_3$, and $D_4$. As will be apparent, radial spacings $D_1$ and $D_4$ represent equilibrium positions of the weight member 38 while $D_3$, as a local minimum radial spacing, represents the turning point between these two equilibrium positions.

With specific regard now to the preferred embodiment illustrated in FIGS. 11–16, the vibration generator 122 is very similar to the vibration generator 22 of the preferred embodiment illustrated in FIGS. 2–9 and described in detail above, and common elements between the two are identified by the same reference numerals.

The second illustrated preferred embodiment of the vibration generator 122 includes a shaft 36 that is rotatable within a bearing housing 128 along an axis of rotation 42 with reference to which a radial direction ρ, axial direction Z, and a circumferential direction θ are defined. The axis of rotation 42 extends longitudinally along the center of the shaft 36, and the radial direction ρ, axial direction Z, and a circumferential direction θ are orthogonal to one another and define a cylindrical coordinate system.

Figure 15:
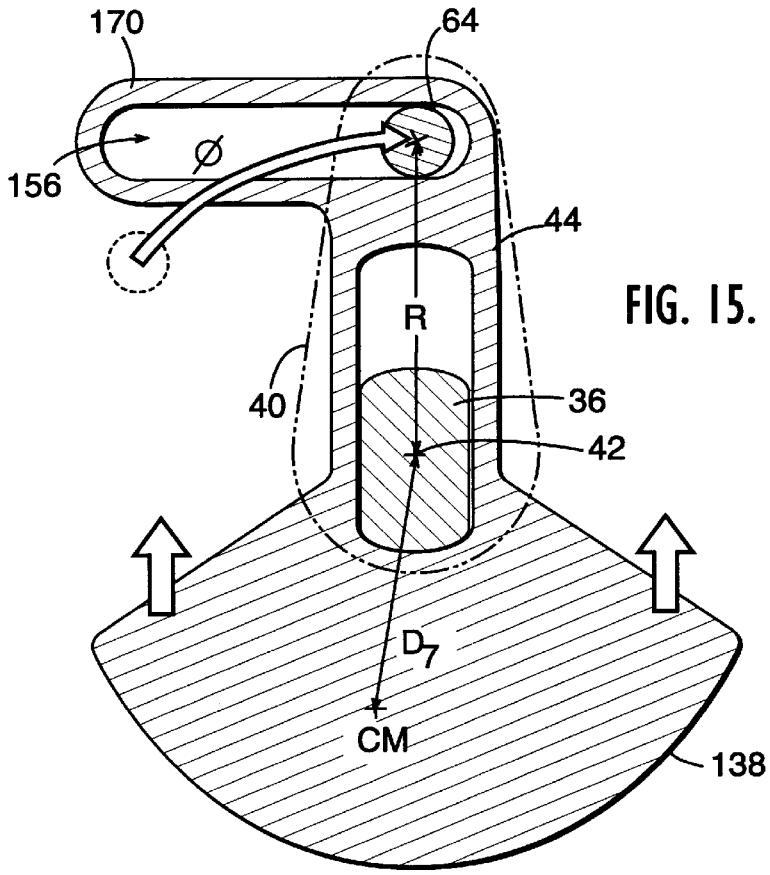
FIG. 15 is a cross-sectional elevational view of the variable amplitude generator of FIG. 11 in a second intermediate position during the transition thereof from a high amplitude position to a stable low-amplitude position.

The vibration generator 122 also includes a weight member 138. The weight member 138 includes an arm portion 44 which defines a mounting slot 46 having a pair of opposed parallel planar sides 48 between which a mounting area of the shaft 36 extends. The mounting area of the shaft 36 includes two parallel planar surfaces 52 which are disposed in sliding abutment with the planar sides when the weight member 138 is mounted to the shaft 36, whereby the weight member 138 is movable relative to the shaft 36 in the radial direction but is precluded from movement relative to the shaft 36 in the circumferential direction. The weight member 138 also includes a pie-shaped weighted portion 154 and a center of mass CM of the entire weight member 138 is located within the weighted portion 154. However, unlike in the first illustrated preferred embodiment, the weight member 138 in the second preferred embodiment also includes an offsetting portion 170 disposed opposite the weighted portion 154 about the axis of rotation 42, with the arm portion 44 connecting the offsetting portion 170 and the weighted portion 154 together. In the second embodiment the offsetting portion 170 defines the positioning slot 156 rather than the weighted portion 54 as in the first embodiment. Furthermore, the positioning slot 156 is not checkmark shaped, but rather, linear and disposed so that it extends tangential to an arc ϕ having a radius equal to the radial extent R of the positioning arm 40 as shown in FIG. 15.

The vibration generator 122 also includes a positioning arm 40 mounted on the shaft 36 adjacent the weight member 138 and rotatable about the axis of rotation 42 relative to both the shaft 36 and the weight member 138. A bearing ring 62 is also mounted on the shaft 36 adjacent the other side of the weight member 138 whereby the weight member 138 is retained adjacent the positioning arm 40 and prevented from axial movement. The bearing ring 62 also represents the portion of the vibration generator 122 that slidably engages the bearing housing 128 and, thus, is the element that directly supports the vibration generator 122 within the bearing housing 128. The positioning arm 40 includes an axially extending portion that extends through the positioning slot 156 defined by the weight member 138. The axially extending portion preferably comprises a cylindrical pin 64 which is slidable along the length of the positioning slot 156. The surface of the pin 64 engages the weight member 138 within the slot and acts as a cam surface 65 during rotation of the positioning arm 40 relative to the shaft 36 and weight member 138.

As in the first illustrated embodiment, an actuating rod 66 is disposed coaxial with the shaft 36 of the vibration generator 122 and is mounted to the positioning arm 40 through a coupling member 68. The actuating rod 66 is driven in rotation by a motor arrangement (not shown) of the compaction machine 20, with driven rotation of the actuating rod 66 causing rotation of the positioning arm 40 about the axis of rotation 42. Preferably, the actuating rod 66 is linked to the compaction drum 24, whereby rotation of the compaction drum 24 drives rotation of the actuating rod 66. The direction of rotation of the actuating shaft 36 can be in either a clockwise or counterclockwise direction as desired. In such an arrangement, movement of the compaction drum 24 results initially in rotation of the actuating rod 66 and positioning arm 40. During rotation of the positioning arm 40, there is a sufficient lack of frictional force between the cylindrical pin 64 and weight member 138 to permit the cylindrical pin 64 extending through the positioning slot 156 to slide within the positioning slot 156 to an end thereof without causing any initial rotation of the weight member 138. Then, once the cylindrical pin 64 engages an end of the positioning slot 156, continued rotation of the positioning arm 40 by the actuating rod 66 results in corresponding rotation of the weight member 138 and shaft 36; hence, counterclockwise rotation of the actuating rod 66 results in counterclockwise rotation of the weight member 138 as shown in FIG. 11, and clockwise rotation of the actuating rod 66 results in clockwise rotation of the weight member 138 as shown in FIG. 12.

As in the first embodiment, different radial dispositions of the center of mass CM of the weight member 138 relative to the axis of rotation 42 results in different moments of inertia of the weight member 138 about the axis of rotation 42. Rotation of the weight member 138 in each different disposition therefore results in different amplitudes of vibration in the shaft 36 which, in turn, are transmitted through the bearing rings 62 to the bearing housing 128 and to the compaction drum 24. The weight member 138 is selectively disposed relative to the axis of rotation 42 to generate different amplitudes of vibration during rotation thereof. Selective disposition of the weight member 138 preferably results from the configuration of the positioning slot 156 and direction of rotation of the positioning arm 40. In particular, the selective disposition of the pin 64 of the positioning arm 40 in each of the two opposed ends of the positioning slot 156 results in different radial dispositions of the weight member 138 and, thus, different amplitudes of vibration.

Figure 13:
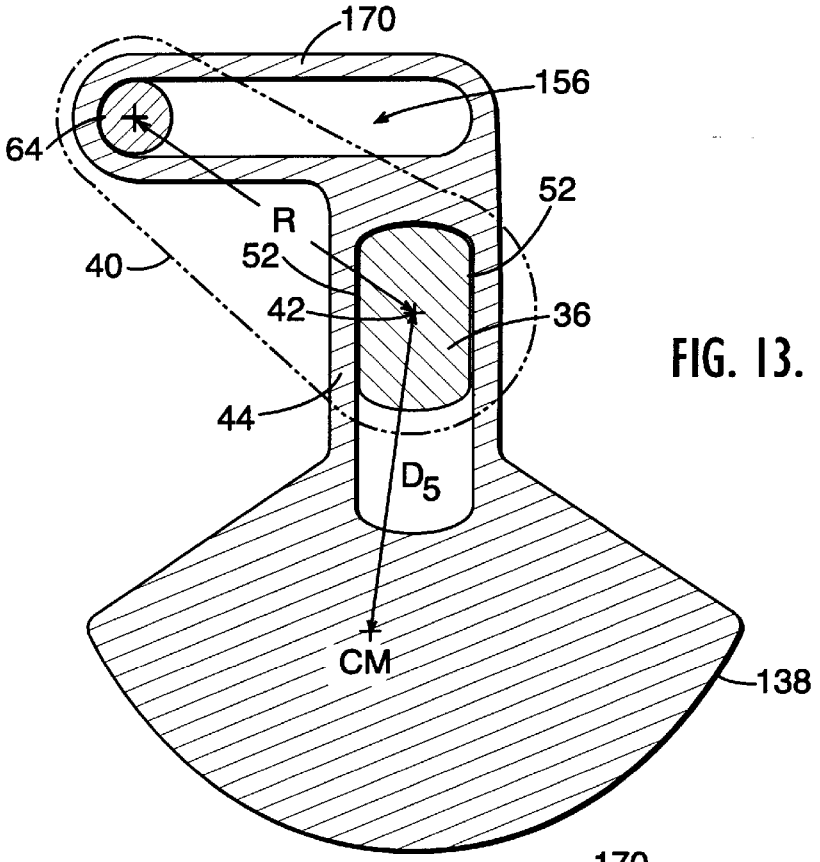
FIG. 13 is a cross-sectional elevational view of the variable amplitude generator of FIG. 11 in a high-amplitude position.
Figure 14:
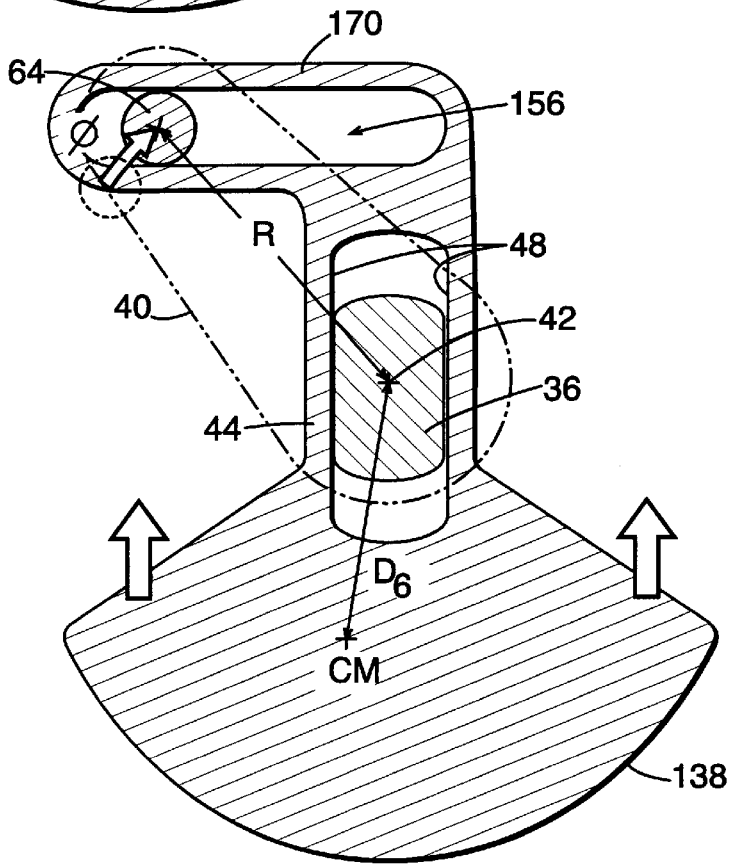
FIG. 14 is a cross-sectional elevational view of the variable amplitude generator of FIG. 11 in a first intermediate position during the transition thereof from a high-amplitude position to a stable low-amplitude position.

The disposition of the weight member 138 in FIG. 11 is shown in cross-sectional elevational view in FIG. 13, wherein the center of mass CM of the weight member 138 is disposed at a radial distance of $D_5$ to the axis of rotation 42. On the other hand, the disposition of the weight member 138 in FIG. 12 is shown in cross-sectional elevational view in FIG. 16, wherein the center of mass CM is disposed at a different radial distance $D_8$ to the axis of rotation 42, with $D_5$ being less than $D_8$. Consequently, the disposition of the weight member 138 shown in FIGS. 11 and 13 is a high-amplitude position (greater eccentricity of the weight member 138) which results in a higher amplitude of vibration than the amplitude of vibration generated by the disposition of the weight member 138 shown in FIGS. 12 and 16, which is a low-amplitude position (lower eccentricity of the weight member 138).

Furthermore, both the high-amplitude position and the low-amplitude position are stable in the vibration generator 122 of the present invention. This stability also results from the configuration of the positioning slot 156. As a result of centrifugal force during rotation of the weight member 138, the weight member 138 will naturally tend toward the greatest radial disposition of its center of mass CM. When the weight member 138 is rotated in the counterclockwise direction as shown in FIG. 11, the weight member 138 is in the high-amplitude position with the greatest radial distance to the axis of rotation 42 and, therefore, will remain in this disposition during rotation. In order to retain the weight member 138 in a stable low-amplitude position at a radial spacing less than that of the high-amplitude position, however, it is necessary to configured the positioning slot 156 so that a local minimum radial spacing of the center of mass CM of the weight member 138 is obtained during the transition of the weight member 138 from the high-amplitude position to the low-amplitude position. This is accomplished by configuring the positioning slot 156 to extend along its from an end thereof first in closer proximity to the axis of rotation 42 and then away from the axis of rotation 42. (One of ordinary skill in the art will note that this is opposite to the first illustrated embodiment since the positioning slot 156 is disposed opposite the weighted portion 154 relative to the axis of rotation 42 in the second embodiment.) Thus, rotation of the positioning arm 40 relative to both the shaft 36 and the weight member 138, which are locked together in the circumferential direction, results in a center of mass CM of the weight member 138 moving relative to the shaft 36 first in a radial direction $-\rho$ toward the axis of rotation 42 and then in a radial direction $+\rho$ away from the axis of rotation 42. The movement of the cylindrical pin 64 between opposite ends of the positioning slot 156 to the other end results in the center of mass CM of the weight member 138 reaching a local minimum (but unstable) radial distance to the axis of rotation 42.

Figure 16:
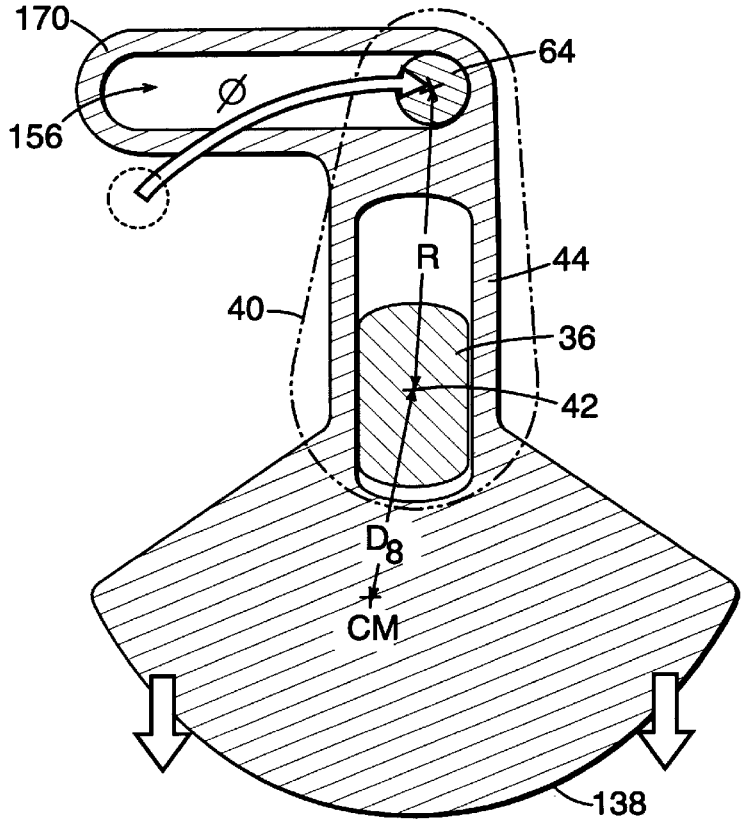
FIG. 16 is a cross-sectional elevational view of the variable amplitude generator of FIG. 11 in a low-amplitude position.

With reference to the sequence of the transition of the weight member 138 from the high-amplitude position as shown in FIG. 11 and FIG. 13 to the low-amplitude position as shown in FIG. 12 and FIG. 16, the radial distance of the center of mass CM first decreases from $D_5$ (FIG. 13) to $D_6$ (FIG. 14) and then to a minimum value of $D_7$ (FIG. 15), and then finally increases to $D_8$ (FIG. 16). While $D_8$ is less than $D_5$, $D_8$ is greater than $D_7$ and, therefore, the weight member 138 will nevertheless still be at a relatively greater radial distance when in the stable low-amplitude position of FIG. 16, will remain in such position, and will not tend toward the high-amplitude position of FIG. 13 as it would first have to pass through the even lower but unstable amplitude position of FIG. 15.

Figure 17:
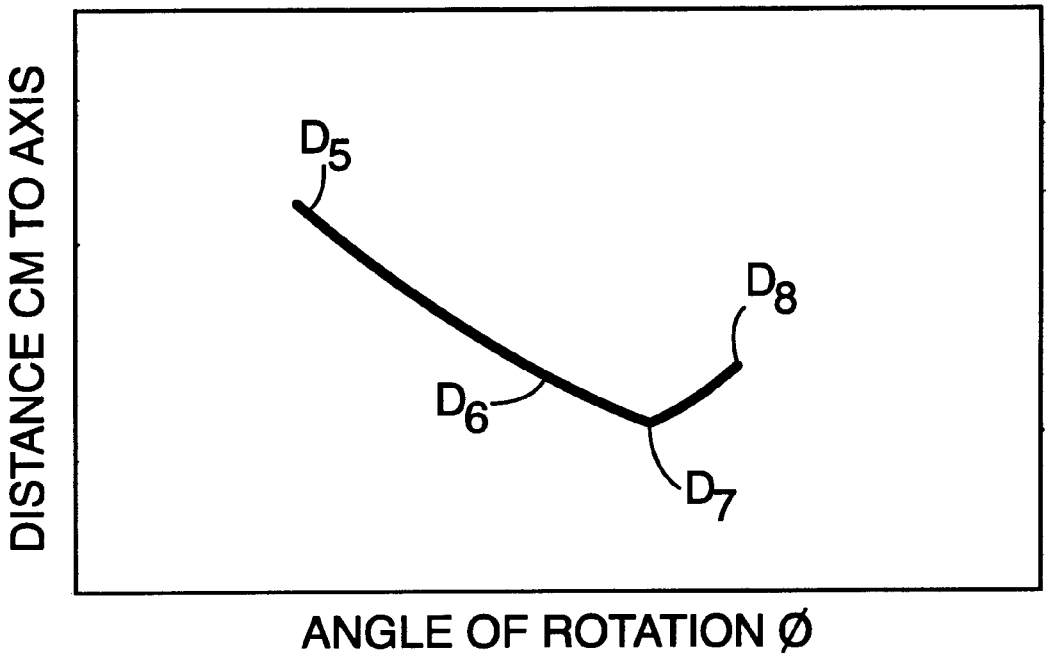
FIG. 17 is a very general graphical illustration of the radial spacing of the center of mass of the weight member as a function of rotation of the positioning arm of the variable amplitude vibration generator of FIG. 11.

The radial distance of the center of mass CM to the axis of rotation 42 is very generally illustrated in FIG. 17 for the sole purpose of comparing the relative values of $D_5$, $D_6$, $D_7$, and $D_8$. As will be apparent, radial spacings $D_5$ and $D_8$ represent equilibrium positions of the weight member 138 while $D_7$, as a local minimum radial spacing, represents the turning point between these two equilibrium positions. The commonality between the first illustrated embodiment and the second illustrated embodiment of the present invention is clearly established by comparison between the graph of FIG. 10 and that of FIG. 17.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

Consequently, it will be obvious that a checkmark shape slot could be provided in an offsetting portion and a linear slot in a weighted portion so long as a local minimum value of the radial distance of the center of mass CM of the weight member is obtained during the transition of the cylindrical pin between the ends of the positioning slot. Furthermore, it should be noted that the location of the center of mass of the weight member on the axis of rotation would result in no vibrations being generated by the rotation of the weight member which would, in such position, then not be eccentric. The positioning slot can therefore be configured to substantially eliminate vibrations by the vibration generator when in a minimal vibratory state by orienting the positioning slot or forming the positioning slot so that the radial distance in the low-amplitude position is minimized to its smallest practical value which accommodates stability in this low-to-no-amplitude position.

Legend

20 compaction machine
22 vibration generator
24 compaction drum
26 road surface
28 bearing housing
30 flange
32 passages
34 enclosed area
36 shaft
38 weight member
40 positioning arm
42 axis of rotation
$\rho$ radial direction
Z axial direction
$\theta$ circumferential direction
44 arm portion
46 mounting slot
48 opposed parallel planar sides
50 mounting area
52 parallel planar surface
54 weighted portion
56 positioning slot
CM center of mass
58 bolt
60 washer
62 bearing ring
64 cylindrical pin
65 cam surface
66 actuating rod
68 coupling member
122 vibration generator (second embodiment)
128 bearing housing
138 weight member
154 weighted portion
156 positioning slot
170 offsetting portion

What is claimed is:

1. A variable amplitude vibration generator for a compaction machine, comprising:

a weight member;

a shaft rotatable about an axis of rotation extending longitudinally therethrough and having a mounting area on which said weight member is mounted; and a positioning arm disposed in engagement with said weight member mounted on said shaft and rotatable about the axis of rotation relative to both said shaft and said weight member so that rotation of said positioning arm relative to both said shaft and said weight member moves said weight member relative to said shaft in a radial direction orthogonal to the axis of rotation thereby altering the moment of inertia of said weight member about the axis of rotation and resulting in a different amplitude of vibration during rotation of said weight member.

2. A variable amplitude vibration generator according to claim 1, wherein said weight member defines an elongate positioning slot and said positioning arm includes an axially extending portion disposed through said positioning slot for slidable movement within said positioning slot during rotation of said positioning member relative to said shaft, said axially extending portion defining a cam surface disposed in engagement with said weight member within said positioning slot.

3. A variable amplitude vibration generator according to claim 2, wherein said weight member includes a weighted portion and an arm portion extending from said weighted portion, said weighted portion defining said positioning slot and said arm portion defining an elongate mounting slot through which said shaft extends in sliding abutment therewith.

4. A variable amplitude vibration generator according to claim 2, wherein said weight member includes a weighted portion, an offsetting portion disposed opposite said weighted portion relative to the axis of rotation, and an arm portion extending between and connecting said weighted portion and said offsetting portion, said offsetting portion defining said positioning slot and said arm portion defining an elongate mounting slot through which said shaft extends in sliding abutment therewith.

5. A variable amplitude vibration generator according to claim 2, wherein said positioning slot extends along its length from an end thereof away from said axis of rotation and then extends in closer proximity to said axis of rotation.

6. A variable amplitude vibration generator according to claim 5, wherein said positioning slot is generally checkmark shaped.

7. A variable amplitude vibration generator according to claim 5, wherein said positioning slot extends parallel to a plane orthogonal to the axis of rotation, and wherein said positioning slot also perpendicularly intersects a radial line orthogonal to the axis of rotation.

8. A variable amplitude vibration generator according to claim 1, wherein said mounting area engages said weight member and prevents movement of said weight member relative to said shaft in a circumferential direction about the axis of rotation but permits movement of said weight member relative to said shaft in a radial direction orthogonal to the axis of rotation and coplanar with the circumferential direction.

9. A variable amplitude vibration generator according to claim 8, wherein said weight member includes an elongate mounting slot having a pair of opposed parallel planar sides between which said mounting area of said shaft extends, and wherein said mounting area includes parallel planar surfaces disposed in sliding abutment with said planar sides.

10. A variable amplitude vibration generator according to claim 1, wherein said weight member includes a pie-shaped weighted portion in which the center of mass of the weight member is located and an elongate arm portion extending from said weighted portion and including an elongate mounting slot through which said shaft extends in sliding abutment therewith.

11. A variable amplitude vibration generator according to claim 10, wherein said positioning member engages said weighted portion.

12. A variable amplitude vibration generator according to claim 10, wherein said weight member further includes an offsetting portion disposed opposite said weighted portion relative to the axis of rotation, said arm portion extending between and connecting said weighted portion and said offsetting portion, said positioning member engaging said offsetting portion.

13. A compaction machine including the variable amplitude vibration generator of claim 1.

14. A variable amplitude vibration generator for a compaction machine, comprising:

a shaft rotatable about an axis of rotation extending longitudinally therethrough;

a weight member defining an elongate mounting slot having a pair of opposed parallel planar sides between which a mounting area of said shaft extends, said mounting area including parallel planar surfaces disposed in sliding abutment with said planar sides whereby movement of said weight member relative to said shaft in a circumferential direction about the axis of rotation is prevented but movement of said weight member relative to said shaft in a radial direction orthogonal to the axis of rotation and coplanar with the circumferential direction is permitted; and a positioning arm disposed on said shaft and rotatable about the axis of rotation relative to both said shaft and said weight member, said weight member also defining an elongate positioning slot and said positioning arm including an axially extending portion defining a cam surface disposed through said positioning slot for slidable movement against said weight member along a length of said positioning slot, said positioning slot extending along said length from an end thereof away from said axis of rotation and then extending in closer proximity to said axis of rotation so that rotation of said positioning arm relative to both said shaft and said weight member moves said weight member relative to said shaft in a radial direction orthogonal to the axis of rotation thereby altering the moment of inertia of said weight member about the axis of rotation and resulting in a different amplitude of vibration during rotation of said weight member.

* * * * *